US005913942A

United States Patent [19]

Roehling

[11] Patent Number: 5,913,942

[45] Date of Patent: Jun. 22, 1999

[54] MECHANISM FOR DRIVING AN OPERABLE MEMBER BY ONE OR ANOTHER OPERATOR ASSEMBLY, BUT NOT BY BOTH OPERATOR ASSEMBLIES SIMULTANEOUSLY

[75] Inventor: Gert Roehling, Hamburg, Germany

[73] Assignee: Daimler-Benz Aerospace Airbus GmbH, Hamburg, Germany

[21] Appl. No.: 08/885,981

[22] Filed: Jun. 30, 1997

[30] Foreign Application Priority Data

Jun. 29, 1996 [DE] Germany ..... 196 26 178

[51] Int. Cl.[6] ..... G05G 11/00

[52] U.S. Cl. ..... 74/483 R; 74/490.14; 74/479.01

[58] Field of Search ..... 74/483 R, 490.14, 74/490.15, 473.21, 473.24, 473.25

[56] References Cited

U.S. PATENT DOCUMENTS

| | | | |
|---|---|---|---|
| 650,010 | 5/1900 | Heller | 74/483 R |
| 1,956,751 | 5/1934 | Zawadzki | 74/483 R |
| 5,492,511 | 2/1996 | Kozminski | 74/483 R |

FOREIGN PATENT DOCUMENTS

| | | | |
|---|---|---|---|
| 568849 | 12/1923 | France | 74/483 R |
| 2651134 | 5/1977 | Germany . | |
| 3437080 | 4/1986 | Germany | 74/483 R |
| 4426865 | 2/1996 | Germany . | |
| 2077042 | 12/1981 | United Kingdom | 74/483 R |

*Primary Examiner*—Charles A. Marmor
*Assistant Examiner*—William C Joyce
*Attorney, Agent, or Firm*—W. F. Fasse; W. G. Fasse

[57] ABSTRACT

A remote control driving mechanism works in the manner of an OR-gate for performing a mechanical switching operation by one of two or more operating control input levers at a time. For this purpose an operable member (2) to be driven is connected to a cam follower (17) which cooperates with two or more cam disks (9, 10) each connected to a respective operating lever (4, 5) through a corresponding push-pull cable (6, 7). Each cam disk (9, 10) has a cam track with a force transmitting section (13, 14) and with a guide section (15, 16) so arranged and configured that the cam follower (17) engages a force transmitting cam track section in one cam disk while engaging a guide cam track section in the other cam disk and vice versa. The sections of each cam track form a U- or V-configuration with a dead point (DP) between the cam track sections. The cam follower (17) is freely movable in the guide track sections, whereby the respective cam disk cannot be operated by its corresponding push-pull cable.

14 Claims, 2 Drawing Sheets

MECHANISM FOR DRIVING AN OPERABLE MEMBER BY ONE OR ANOTHER OPERATOR ASSEMBLY, BUT NOT BY BOTH OPERATOR ASSEMBLIES SIMULTANEOUSLY

FIELD OF THE INVENTION

The invention relates to mechanical remote control devices employing, for example push-pull cables to remote control an operable member which may be part of a steering mechanism or the like. The simultaneous operation of both operator assemblies must be prevented. Thus, the operation of one of the operator assemblies must simultaneously disable any operation of the other operator assembly and vice versa.

BACKGROUND INFORMATION

German Patent Publication DE 4,426,865 describes a control mechanism in which an operable member also referred to as follower or adjustable member can be selectively controlled remotely from two separate locations. The known control mechanism comprises first and second operating levers or control inputs which are connected through respective push-pull cables with a drive lever that in turn is connected to the follower or adjustable member through a switch over element and through a further lever that actuates the follower or adjustable operable member. The switch over element makes sure that an adjustment motion of one of the operating levers releases the other operating or control input levers so that it cannot be operated during operation of one of the levers. Thus, the two operator assemblies cannot influence each other while one of the operator assemblies is being operated. The switch over element is constructed as a symmetric component with lateral recesses. The symmetric component is connected to the free end of the lever that is itself connected to the operable member. Engagement tongues enter selectively into the recesses, whereby these tongues cooperate with the respective control input levers. If one of the two operating levers is actuated, the input lever entrains the lever of the operable member through lateral stops and the engagement tongue of the input lever engages into the recess of the switch over element in order to tilt the switch over element in such a way that the respective other input lever is released end thus prevented from being operable. The mechanism disclosed in German Patent Publication DE 4,426,865 requires a multitude of tiltable levers and other components resulting in a rather complicated and expensive construction that is prone to require substantial maintenance efforts.

German Patent Publication 2,651,134 (Paul), published on May 18, 1977, also discloses an apparatus for connecting two alternately operable operating or input levers with an operable element. Such an apparatus may, for example be used for operating two control cables for reversing a gear in a gear reversing mechanism of a boat motor. The control cables are control input cables the ends of which are connected through a lever and cam follower mechanism to an outgoing or controlled cable for the power transmission. The lever and cam follower mechanism includes cam tracks that are mirror-symmmetrical relative to each other. The mechanism must be so dimensioned that only one power transmitting path can be established at a time from one of the incoming cables to the outgoing cables with the help of at least two mirror symmetrically arranged cam follower rollers (15, 16) or with at least two pipe sections (66, 67) travelling along two oval cam track sections (57, 58) positioned mirror symmetrically opposite each other.

The above described prior art leaves room for improvement, especially with regard to the number of components employed for achieving the intended purpose.

OBJECTS OF THE INVENTION

In view of the above it is the aim of the invention to achieve the following objects singly or in combination:

- to construct a remote control adjusting mechanism in such a way that a few structural components cooperating with each other assure the intended function reliably to permit operation with one or another operator assembly, but not with both;
- to substantially reduce the manufacturing costs as well as the maintenance effort and expense for such remote control mechanisms;
- to configure two cam tracks in such a way that almost any desired transmission ratio may be accomplished, even a non-constant or a transmission ratio that is variable during operation;
- to construct a compact driving mechanism for remote operating an operable member that is mounted in a hard-to-access, limited space remote location; and
- to make sure that the mechanism functions as an "OR"-device, namely permitting the operation of the operable element by one or the other operator assembly or control input but not by both simultaneously.

SUMMARY OF THE INVENTION

According to the invention the present remote control driving mechanism comprises at least two operator assemblies forming a switch-over mechanism (8) constructed as a cam drive comprising at least two cam drive disks (9, 10), one for each control input. The cam disks (9, 10) are coupled with each other but can rotate relative to each other. Each cam disk is connected through a push-pull cable (6, 7) to a respective control input (4, 5) such as an operator controlled lever. Each cam disk comprises a cam track and each cam track includes a force transmitting first cam track section (13, 14) and a guide second cam track section (15, 16) so positioned that a single cam follower (17) is movable in these first and second cam track sections for the transmission of the control force from one of the control inputs formed by the operating levers (4, 5) to an operable member connected to the cam follower (17), either directly or indirectly through en intermediate member (2). The cam tracks are so configured that operation of one of the control inputs disables an operation of the other control input and vice versa, whereby only one of the control inputs can be operated at a time.

It is a special advantage of the invention that only a few relatively simple structural components cooperate with each other in achieving the above objects. Another important advantage of the invention is seen in that almost any desired transmission ratio including variable transmission ratios can be realized by the simple device of the cam track configurations in which a single cam follower roller is movable. Another advantage of the invention is seen in that a plurality of identical cam disks may be arranged one behind the other in a row so that a single cam follower can cooperate with all of the cam disks but can be driven only by one dam disk at a time, namely the one that has been activated, whereby all other cam disks in a row are deactivated.

BRIEF DESCRIPTION OF THE DRAWINGS

In order that the invention may be clearly understood, it will now be described, by way of example, with reference to the accompanying drawings, wherein.

Figure 1:
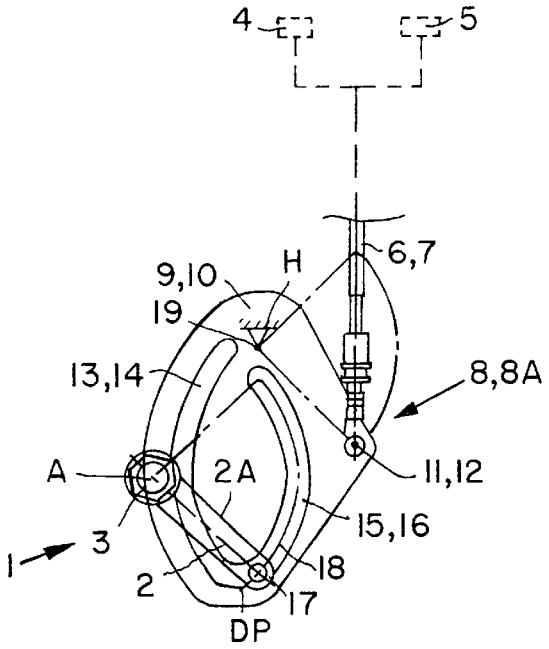
FIG. 1 shows a schematic side view of the present driving mechanism in the "OFF" position of an operable member, with a friction drive between a cam follower (17) and two cam disks arranged one behind the other in a row.

DETAILED DESCRIPTION OF PREFERRED EXAMPLE EMBODIMENTS AND OF THE BEST MODE OF THE INVENTION

In each of FIGS. 1, 2, 3 and 4 a driving or operating mechanism 1 includes two operator assemblies 8 and 8A. One operator assembly, e.g. the first operator assembly 8, remains stationary while the second operator assembly 8A is shown to move from an OFF-position in FIG. 1 into an ON-position in FIG. 4. However, the operation could also be illustrated so that the second operator assembly 8A remains stationary while the first operator assembly 8 performs the motion, depending on which control input such as a lever 4 or 5 has been activated, as will be described in more detail below. The operator assembly 8 is driven by its input lever 4. The operator assembly 8A is driven by its input lever 5. It is assumed that the lever 5 is being operated to bring an operable member 2 from the OFF-position into the ON-position with the help of a push-pull cable 7 forming part of the operator assembly 8A. The other assembly 8 is operable through a push-pull cable 6 by the lever 4. Each cable 6 and 7 is pivoted at 11 or 12 respectively to a corresponding cam disk 9 and 10 forming part of the respective operator assembly.

The operable member 2 is preferably a lever which is rigidly connected to a power output shaft 3 for rotating the power output shaft to perform the intended operation, for example operating a valve or valves or an interlocking device, or for controlling in open loop fashion any mechanism or machine forming an operated device not shown. In all instances one of the operator assemblies 8, 8A remains stationary while the other moves or vice versa. The two input control levers 4 and 5 with their respective push-pull cables 6 and 7 may be positioned at different locations for the intended remote control of the corresponding cam disk. Such a remote operation is for example required if the member or device to be operated is installed in a location that is hard to access so that the respective operating force needs to be transmitted over a certain distance. One or the other push-pull cable 6 or 7 permits operating the operable member or lever 2. However, if operation of one of the input levers 4 or 5 begins, it is necessary that the other input lever with its operator assembly is disabled, for example disengaged or blocked so that no intermixing of operating steps can take place.

For the above purpose the operating mechanism, comprises the two mentioned cam disks 9 and 10 in this particular example embodiment. However, more than two cam disks may be used in a row. The cam disks which are pivoted or journalled at the respective pivoting points 11 or 12 to the corresponding push-pull pull or Bowden cables 6 or 7 comprise a special cam track according to the invention. All cam tracks in all cam disks are of the same configuration. Each cam track has two sections, namely a force transmitting section 13 or 14 and a guide section 15 or 16 respectively in which a cam follower 17 is freely movable, for example with a cam follower roller at one end of the cam follower.

The cam follower 17 is rigidly secured to a free end of the operable lever 2, the other end of which is rigidly connected to a drive shaft 3 that outputs a control force. The drive shaft 3 is rotatably mounted in a housing H. The cam follower 17 can be driven by the cam disks 9 or 10 depending on which of the input levers 4 or 5 is operated, whereby the operable lever 2 is driven into the required position by the operated cam disk 9 or 10, while the respective other cam disk 10 or 9 is disabled, whereby the respective operating lever 4 or 5 remains in its starting or zero position in which it cannot be operated as long as one input lever is operated. For this purpose the two cam disks 9 and 10 are journalled to a common journal 19 rigidly secured in the housing H. Thus, the two cam disks 9 and 10 are coupled to each other, but are permitted to independently rotate about the journal shaft 19. Assuming that the lever 5 has been operated, whereby the cable 7 begins operating the cam disk 10, the cam follower 17 will travel in the force transmitting cam section 14 of the cam disk 10 while simultaneously travelling freely along the guide track 15 of the cam disk 9 whereby the latter remains stationary. For this purpose the cam follower 17 is made of a wear resistant material and a high friction must be provided between the cam follower 17 and the respective force transmitting cam section 13 or 14 in order to provide a frictional force transmission and to avoid any sliding motion between the cam follower 17 and the force transmitting cam track section. Since the cam follower 17 in the present example in which the lever 5 is being operated, moves freely in the guide track section 15 of the disk 9, the disk 9 remains stationary, and since the cam follower 17 simultaneously engages the force transmitting cam track section 14 of the cam disk 10 the latter will transmit the intended motion. The opposite applies if the lever 4 is being operated, whereby the lever 5 remains disabled. The operation is the same even if more than two operator assemblies, each with its lever, cable, and disk are used. If any one input lever is activated, all the other input levers are disabled until operation of the one lever stops.

In the preferred embodiment the two cam track sections 13 and 15 is of the cam disk 9 and the two cam track sections 14 and 16 of the cam disk 10 form respectively an approximately U- or V-configuration, whereby one leg of the configuration forms the force transmitting cam track section while the other leg of the configuration forms the guide cam track section which permits a free running of the cam follower 17 in the respective guide cam track section 15 and 16. For this purpose the guide cam track sections 15 and 16 are wider than the force transmitting cam track sections 13 and 14. The legs of the configurations are slightly outwardly curved, in order to permit the free running of the cam follower 17 in the respective guide track section 15 or 16. The curvature of the guide track section corresponds to a circular path sector 18 having its center on the rotational axis A of the driven or output shaft 3, whereby the cam follower 17 can freely travel along the guide sections 15, 16.

Guides permitting a free running of the cam follower 17 other than the described guide track sections 15, 16 are possible, whereby attention must be paid to the requirement that the free running or guiding of the cam follower 17 in response to a force input does not transmit a force to the cam disk that needs to be disabled. The configuration of the force transmitting cam track section 13, 14 depends on the desired transmission ratio between the operating element 4 or 5 and the operated or operable lever 2 in the respective switching position of the drive mechanism 1. A non-constant transmission ratio is preferred, because for example at the beginning of a switching operation a higher starting torque moment prevails that must be overcome. A technical limitation of the transmission ratio depends on two facts, namely the maximum distance that the cam follower 17 must travel to accomplish the switching and positions in which the cam follower 17 is blocked or arrested in one of the force transmitting cam track sections 13 or 14. Such blocking positions must be avoided.

An operational sequence of the example embodiment shown will now be described. As mentioned, in FIG. 1 the controlled or operable lever 2 is not yet operated and thus in its OFF-position. The cam disks 9 and 10 are aligned in this position with each other and since they have an identical configuration the cam disk 10 is hidden behind the cam disk 9. At this point the cam follower 17 engages both cam tracks of both cam disks at the dead point DP in FIG. 1. The dead point DP is positioned at the switch over or transition point between the track section 13 and 15 and respectively between the track sections 14 and 16.

Figure 3:
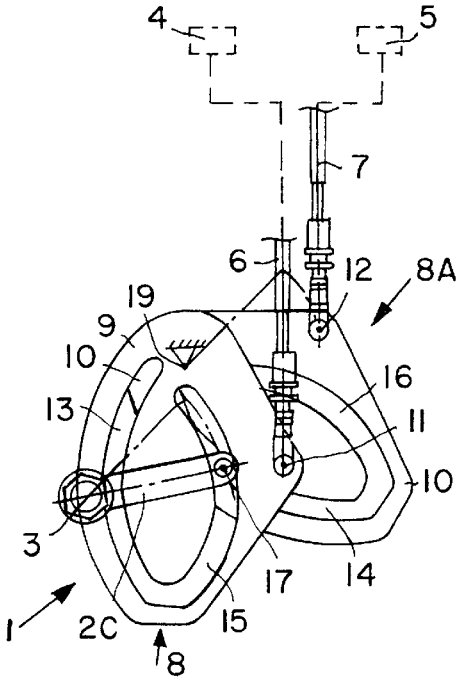
FIG. 3 illustrates said one cam disk (10) still advancing toward the ON-position while the other cam disk (9) remains stationary.
Figure 2:
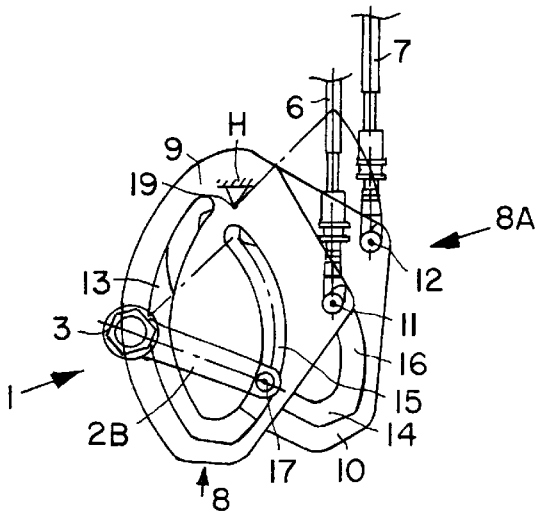
FIG. 2 is a view similar to that of FIG. 1, but illustrating a first motion phase, wherein one cam disk (10) has started its motion toward an "ON" position while the other cam disk (9) remains stationary.

With the operation of the control input 5, the Bowden cable 7 causes an adjustment or drive motion as illustrated in FIGS. 2 and 3. The cam disk 10 rotates about the journal shaft 19 in a counterclockwise direction as seen by the viewer, thereby displacing the cam follower 17 in the force transmitting cam track section 14 of the cam disk 10, whereby the lever 2 also travels counterclockwise from the position 2A in FIG. 1 through the positions 2B in FIG. 2 and 2C in FIG. 3 to the position 2D in FIG. 4 corresponding to the ON-position. The cam disk 9 remains in a stationary position since the cam follower 17 can freely move in the guide track section 15, whereby any operation of the lever 4 and the push-pull cable 6 is disabled. Thus, the possibility of operating both levers 4 and 5 simultaneously or immediately in sequence is prevented. For achieving the position 2D shown in FIG. 4, the present drive mechanism functions as an "OR-gate" so to speak.

Figure 4:
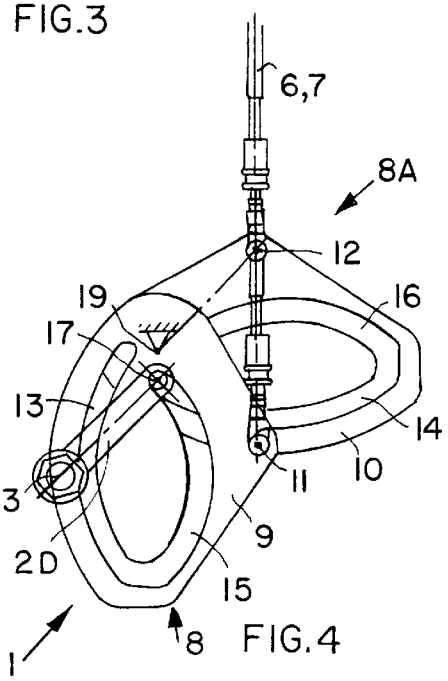
FIG. 4 illustrates the position of the cam disks (9, 10) relative to each other in the "ON"-position, whereby the other cam disk (9) is still in the same position.

In the ON-position 2D shown in FIG. 4 the operable lever 2 and the cam follower 17 have each reached an end position in the respective track sections of the cam disks 9 and 10. The cam disk 9 is still in its starting position. However, the cam follower 17 has reached the end point of the guide track 15. The push-pull cable 7 has moved the cam disk 10 about the journal axis 19 into its respective end position and the cam follower 17 accordingly is also at the end position of the force transmitting cam track section 14. If the drive mechanism 1 is to be returned into the OFF-position, the lever 5 is accordingly operated, whereby the push-pull cable 7 now must transmit a pushing force in order to move the cam disk 10 clockwise about the journal shaft 19, whereby the cam follower 17 travels back along the force transmitting cam section 14, thereby bringing the lever 2 into the OFF-position. At the end of this operation both operating levers 4 and 5 must again be in their starting position.

Figure 5:
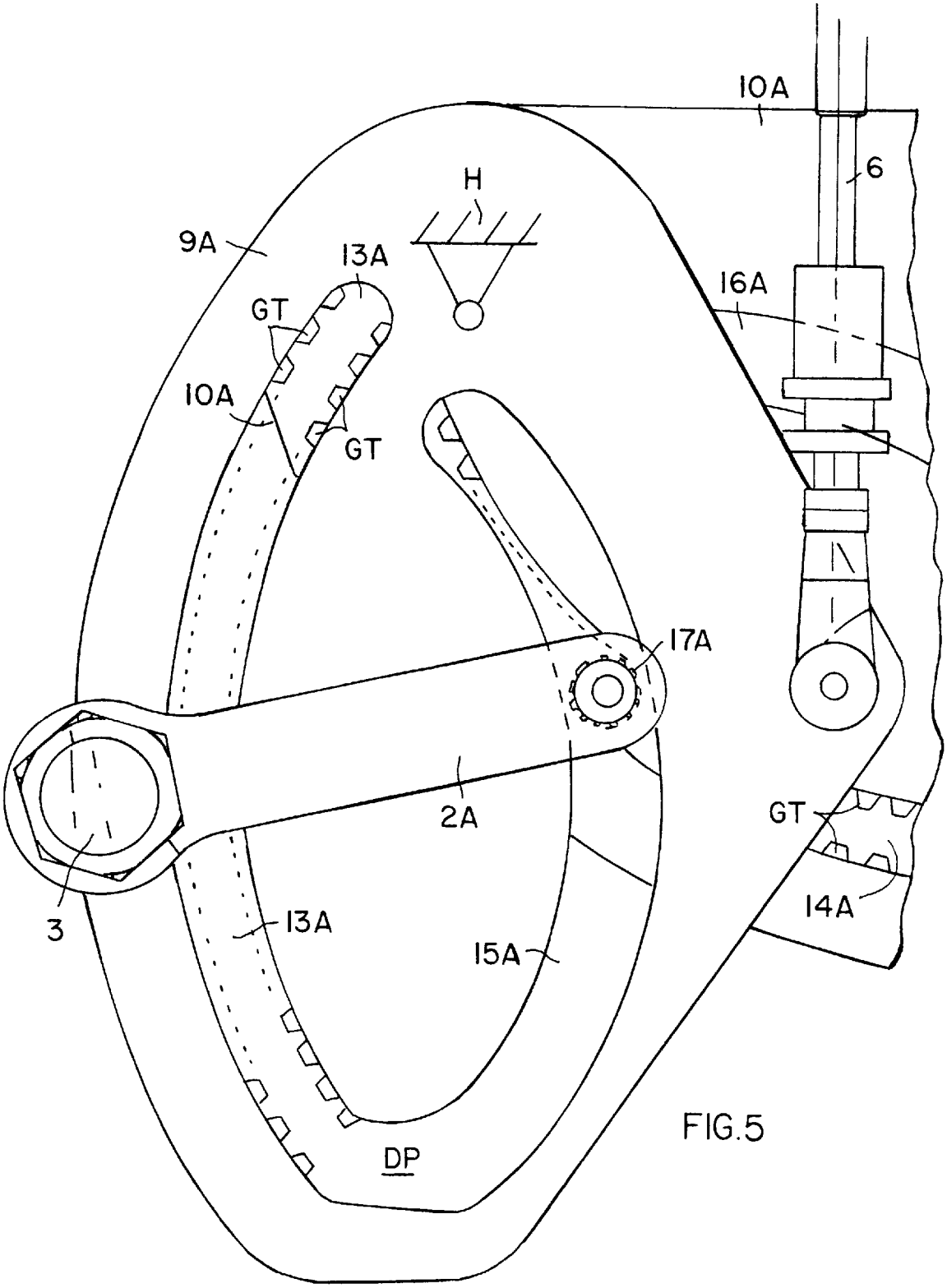
FIG. 5 shows on an enlarged scale a modified embodiment of the invention with a pinion as a cam follower meshing with gear teeth along the force transmitting cam track section.

In a further embodiment shown in FIG. 5, a cam follower 17A is constructed as a pinion rotatably connected to an operable lever 2A. The pinion 17A travels along gear teeth GT provided along force transmitting cam track sections 13A and 14A in the cam disks 9A, 10A. To fulfill the force transmitting function of the force transmitting cam track sections 13A and 14A, it is necessary to ensure that only one row of teeth, of force transmitting cam track section 13A or 14A, has a form locking connection to pinion 17A. For this the force transmitting cam track sections 13A and 14A must have a clearance, that is sufficient for the required form locking connection between the pinion 17A and only one row of teeth of force transmitting cam track section 13A or 14A. The guide track sections 15A and 16A do not require any gear teeth because the pinion 17A must be able to freely run along these guide track sections 15A, 16A. For this purpose the guide track sections 15A and 16A have a clearance that is sufficient for the required free running of the pinion in these guide track sections 15A, 16A. A transmission of a frictional force is avoided due to the meshing of the pinion 17A with the gear and the teeth GT along the force transmitting cam track sections 13A and 14A. Such a gear transmission is preferred if the operation of the lever 2 must be accomplished by a small input force. Although cam tracks 13A, 14A with two rows of gear teeth GT are shown and preferred, one row of teeth may be sufficient for light duty applications.

Although the invention has been described with reference to specific example embodiments, it will be appreciated that it is intended to cover all modifications and equivalents within the scope of the appended claims.

What is claimed is:

1. A remote control mechanism comprising an operable member (2), at least a first operator assembly and a second operator assembly, each operator assembly comprising a control force input (4; 5) thereby providing at least a first control force input (4) and a second control force input (5), a force transmitter (6; 7) and a cam disk (9; 10) connected to said first and second control force inputs (4; 5) through said force transmitter, respectively, for driving said operable member (2), a coupling (19) connecting said cam disks (9, 10) to each other for permitting relative rotation between said cam disks, each cam disk (9; 10) comprising a force transmitting first cam track section (13; 14) and a guide second cam track section (15; 16), a cam follower (17) operatively connected to said operable member (2), said cam follower (17) cooperating with said first and second cam track sections (13; 14; 15; 16) which are so configured that operation of said first control force input disables an operation of said second control force input and vice versa, whereby only one of said control force inputs can be operated at a time, further comprising a power output shaft (3), said operable member (2) having a first end rigidly connected to said power output shaft (3) for rotating said power output shaft (3) through said operable member (2), said operable member (2) having a second end operatively connected to said cam follower (17) for driving said operable member (2) by one or the other of said first and second operator assemblies.

2. The mechanism of claim 1, wherein said first and second track sections together form in each cam disk a cam track having approximately a U-configuration or a V-configuration, whereby one leg of said U- or V-configuration forms said force transmitting cam track section and the other leg of said U- or V-configuration forms said guide track section.

3. The mechanism of claim 1, further comprising a frictional engagement between said force transmitting first cam track section (13, 14) and said cam follower (17).

4. The mechanism of claim 1, wherein said cam follower (17) is made of a wear resistant material.

5. The mechanism of claim 1, further comprising a positive, form locking connection between said force transmitting first cam track section and said cam follower.

6. The mechanism of claim 5, wherein said positive, form locking connection comprises gear teeth (GT) along said force transmitting first cam track sections (13A, 14A) and a pinion (17A) forming said cam follower for meshing with said gear teeth (GT) in said force transmitting first cam track sections (13A, 14A), and wherein said guide second cam track sections (15A, 16A) are wide enough for said cam follower pinion (17A) to a move freely in said guide second cam track sections (15A, 16B).

7. The mechanism of claim 1, wherein said coupling connecting said cam disks (9, 10) to each other comprises a journal shaft (19) mounted in a housing (H) for permitting rotation of each cam disks about said journal shaft (19) relative to each other.

8. The mechanism of claim 1, wherein said force transmitters comprise two Bowden cables (6, 7) one end of which is pivoted to a respective one of said cam disks (9, 10) and the other end of which is connected to a respective one of said first and second control force inputs (4, 5).

9. The mechanism of claim 1, wherein one cam disk remains stationary when the other cam disk is operated and vice versa.

10. The mechanism of claim 1, wherein said first and second cam track sections (13, 15; 14, 16) comprise a dead point (DP) at a transition between said first and second cam track sections.

11. The mechanism of claim 1, further comprising a sliding guide fit between said cam follower (17) and said guide second cam track sections (15, 16).

12. The mechanism of claim 11, wherein said cam follower comprises a cam follower roller at one end of said cam follower.

13. The mechanism of claim 1, further comprising a housing (H) wherein said power output shaft (3) is rotatably mounted.

14. A remote control mechanism comprising a rotatable operable member (2), at least a first operator assembly and a second operator assembly, each operator assembly comprising a control force input (4; 5) thereby providing at least a first control force input (4) and a second control force input (5), a force transmitter (6; 7) and a cam disk (9; 10) connected to said first and second control force inputs(4; 5) through said force transmitter, respectively, for driving said operable member (2) in rotation, a coupling (19) connecting said cam disks (9, 10) to each other about a common axis for permitting relative rotation between said cam disks, each cam disk (9; 10) comprising a curved force transmitting first cam track section (13; 14) and a curved guide second cam track section (15; 16), a cam follower (17) operatively connected to said operable member (2), said cam follower (17) cooperating with said curved force transmitting first cam track section of one of said cam disks (9; 10) and with said curved guide second cam track section of the other of said cam disks, and vice versa, said curved first and second cam track sections having such a curvature; that operation of said first control force input disables an operation of said second control force input and vice versa, whereby only one of said control force inputs can be operated at a time for converting a linear control force of the respective force transmitter (6; 7) into a torque of said operable member.

* * * * *